United States Patent [19]

Uramoto et al.

[11] Patent Number: 5,017,797

[45] Date of Patent: May 21, 1991

[54] DEVICE FOR DETECTING YARN

[75] Inventors: Makoto Uramoto, Uji; Hideji Sakata, Nagaokakyo, both of Japan

[73] Assignee: Murata Kikai Kabushiki Kaisha, Kyoto, Japan

[21] Appl. No.: 440,022

[22] Filed: Nov. 21, 1989

[30] Foreign Application Priority Data

Nov. 24, 1988 [JP] Japan ..... 63-296546
Jan. 17, 1989 [JP] Japan ..... 1-3759[U]

[51] Int. Cl.[5] ..... G01N 21/86
[52] U.S. Cl. ..... 250/561; 57/81
[58] Field of Search ..... 250/561, 571, 572, 562; 57/81; 28/187; 242/37 R; 19/0.21, 0.25; 66/161; 139/273 A; 356/238, 430

[56] References Cited

U.S. PATENT DOCUMENTS 2,991,685 7/1961 Van Dongeren ..... 250/562
4,311,916 1/1982 Schenkel ..... 250/561
4,404,791 9/1983 Wolf et al. ..... 57/81

*Primary Examiner*—David C. Nelms
*Attorney, Agent, or Firm*—Spensley Horn Jubas & Lubitz

[57] ABSTRACT

A device for detecting a doubled yarn includes a detecting device having photoelectric sensors disposed in a plane perpendicular to a running path of a yarn provided in a housing such that beams of light projected from light projecting elements may reach light receiving elements in a perpendicularly intersecting relationship to each other. A calculating device totals up the sensed amounts individually detected by the light receiving elements of the photoelectric sensors and comparing the added up value with a reference value to detect a break of one or more of the single yarns of the doubled yarn.

15 Claims, 3 Drawing Sheets

DEVICE FOR DETECTING YARN

FIELD OF THE INVENTION AND RELATED ART STATEMENT

This invention relates to detecting device for a textile machine, particularly for a yarn doubling and take-up machine.

In a textile machine wherein yarns are taken up after they are doubled, detection of a yarn break is performed by a detecting device provided for a yarn each single yarn which forms the doubled yarn.

Consequently, such detecting devices are provided in a number equal to the number of single yarns. This results in problems related to the spacing which is required for such detecting devices in addition to increases in cost.

OBJECT AND SUMMARY OF THE INVENTION

It is an object of the present invention to obtain a detecting device which can detect a break of of a single yarn of a doubled yarn with a high degree of accuracy. The detecting device is provided in a yarn path after the single yarns are doubled.

A device for detecting a yarn comprises a detecting means including a pair of photoelectric sensors disposed in a plane perpendicular to a running path of a yarn. The photoelectric sensors are provided in a housing such that beams of light projected from light projecting elements may reach light receiving elements in a perpendicularly intersecting relationship to each other for detecting shadows of a plurality of single yarns passing the intersecting location. The projected light beams are sensed individually at light receiving elements of the photoelectric sensors, and a calculating means is provided for adding up sensed amounts individually detected by the light receiving elements of the pair of photoelectric sensors. The calculated value is compared with a reference value to detect a break of one or more of the single yarns which make up the doubled yarn.

The light receiving elements of the pair of photoelectric sensors detect sensed amounts obtained from shadows of single yarns constituting a doubled yarn, and the sensed amounts are added up, and then the thus added up value is compared with the reference value to detect a yarn break of one or more of the single yarns.

DETAILED DESCRIPTION OF PREFERRED EMBODIMENTS

Figure 1:
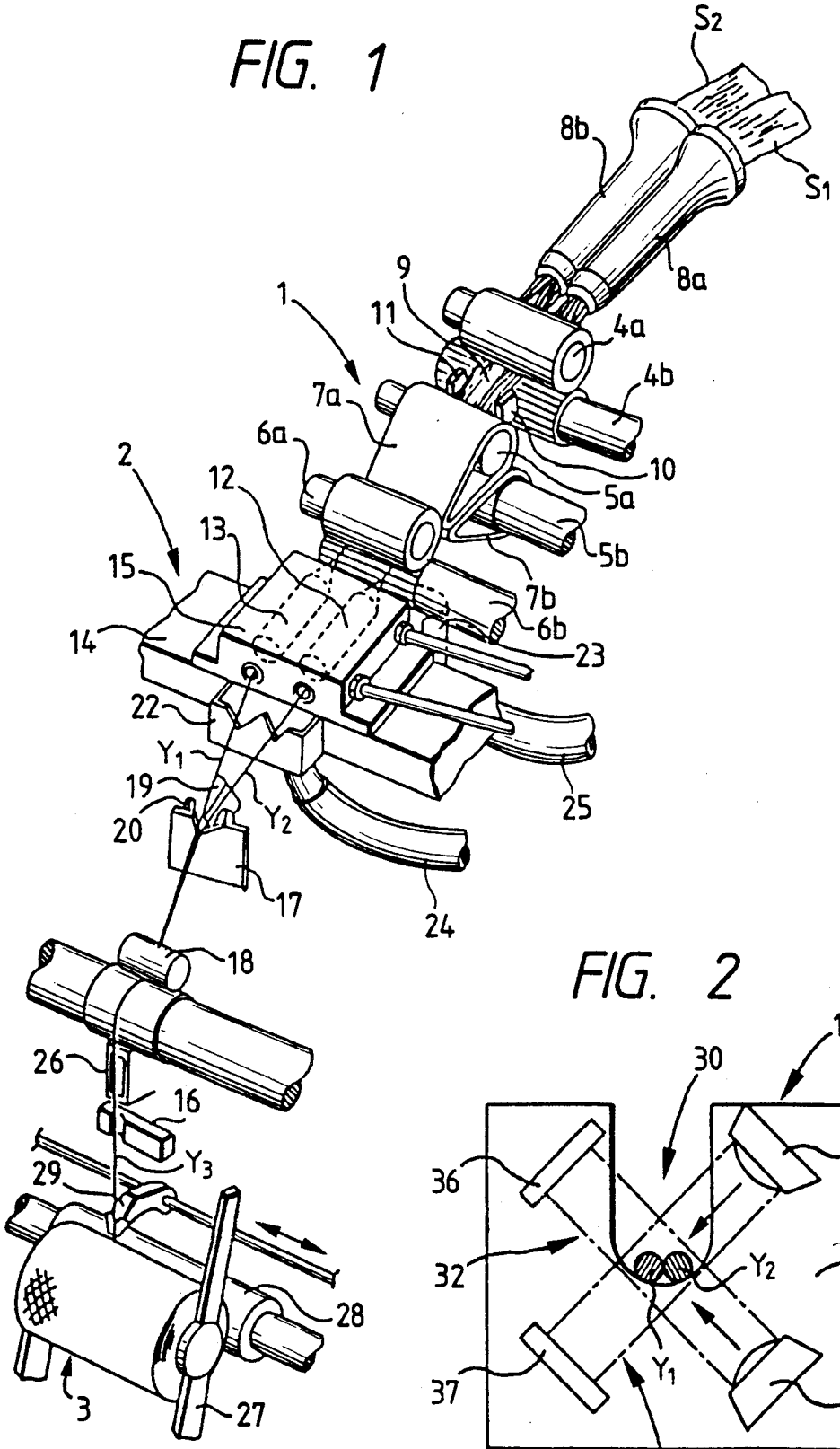
FIG. 1 is a perspective view showing a spindle of a textile machine of the yarn doubling type which includes an optical yarn sensor of the present invention.

In the following, embodiments of the present invention will be described with reference to the drawing.

FIG. 1 is a perspective view showing a spindle of a spinning apparatus which includes a yarn detecting device of the present invention, and the spindle includes a drafting device 1 for drafting slivers $S_1$ and $S_2$ supplied from a plurality of sliver cans not shown, a twisting device 2 based on air jets for twisting the slivers $S_1$ and $S_2$ drafted by the drafting device 1 to form single yarns $Y_1$ and $Y_2$, and a take-up device 3 for joining the thus spun single yarns $Y_1$ and $Y_2$ together to form a doubled yarn $Y_3$ and taking up the doubled yarn $Y_3$. The drafting device 1 includes a pair of back rollers 4*a* and 4*b*, a pair of middle rollers 5*a* and 5*b*, and a pair of front rollers 6*a* and 6*b*, and the pair of middle rollers 5*a* and 5*b* have apron belts 7*a* and 7*b* provided thereon. Reference characters 8*a* and 8*b* denote sliver guides which are placed in a parallel relationship for feeding the slivers $S_1$ and $S_2$ supplied from the sliver cans between the pair of back rollers 4*a* and 4*b*. Meanwhile, reference numeral 9 denotes a separating guide for slivers provided between the pair of back rollers 4*a* and 4*b* and the pair of middle rollers 5*a* and 5*b*, and the separating guide 9 separates the slivers $S_1$ and $S_2$ inserted in a parallel condition between the pair of back rollers 4*a* and 4*b*. Further, a pair of guide blocks 10 and 11 are provided on the left and right of the separating guide 9, respectively, and restrain leftward and rightward expansion of the two rows of slivers $S_1$ and $S_2$ separated by the separating guide 9.

Accordingly, the two rows of slivers $S_1$ and $S_2$ separated at the position of the separating guide 9 are drafted while maintaining the condition of the two parallel rows also at the following position of the pair of middle rollers 5*a* and 5*b* and at the position of the pair of front rollers 6*a* and 6*b* and then introduced in a parallel condition into a pair of air jetting nozzles 12 and 13 of the twisting device 2. The twisting device 2 is constituted such that the air jetting nozzles 12 and 13 are provided in a parallel condition in a housing 15, and each of the air jetting nozzles 12 and 13 has a function to independently twist the sliver $S_1$ or $S_2$ supplied thereto to form a single yarn $Y_1$ or $Y_2$.

An optical yarn sensor 16 of the present invention is provided as a slab catcher which is located at the down stream side of a guide member 17, which is provided for doubling the single yarns $Y_1$ and $Y_2$ obtained by the twisting step 2 described above to form a doubled yarn, and a delivery roller 18.

Reference numeral 19 denotes a separating guide for preventing a joining point of the single yarns $Y_1$ and $Y_2$ near the guide member 17 from floating upstream or downstream along the yarn path. The separating guide 19 prevents an irregularity in the amount of entangled portions of the single yarns $Y_1$ and $Y_2$ which is caused when the joining point floats upstream.

Reference numeral 20 denotes a cutter provided at the position of the guide member 17, and the cutter 20 is rendered operative in response to a yarn defect detection signal from a slub catcher 16 which is provided intermediately of a yarn path passing the delivery roller 18 and extending downwardly to the take-up device 3 for detecting a defective portion of a yarn.

Reference numerals 22 and 23 denote each a dust sucking port for a waste yarn, fly waste and so forth, and reference numerals 24 and 25 denote each an air sucking pipe.

Reference numeral 26 denotes a slack tube for sucking, upon starting of spinning or upon yarn splicing, single yarns $Y_1$ and $Y_2$ spin out from the air jetting nozzles 12 and 13 to prevent slackening of the yarns. The take-up device 3 is constituted from a bobbin supported on a known cradle arm 27, a friction roller 28 for rolling contact with the bobbin (or a package) to drive the bobbin to rotate, and a traverse guide 29.

Figure 2:
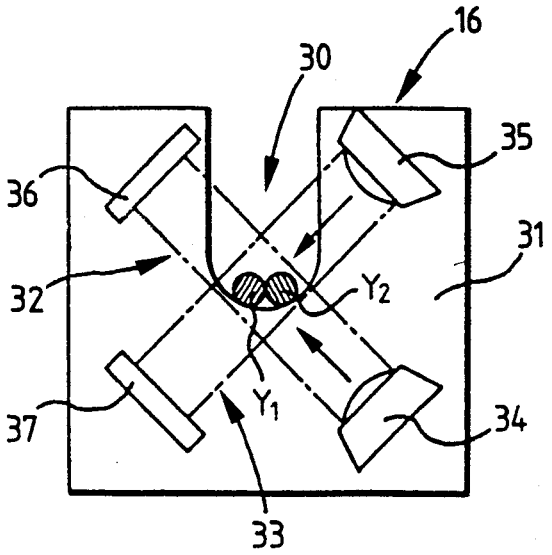
FIG. 2 is a front elevational view of the optical yarn sensor of the present invention.

The optical yarn sensor 16, which is provided to be the slub catcher in this embodiment, includes, as shown in FIG. 2, a detecting means including a pair of photoelectric sensors 32 and 33 provided in a housing 31 having a U-shaped yarn running path 30, and a calculating means which will be hereinafter described.

The photoelectric sensors 32 and 33 of the detecting means are disposed on a plane perpendicular to the yarn running path 30 such that projected beams of light from light projecting elements 34 and 35 of the individual photoelectric sensors 32 and 33 may reach light receiving elements 36 and 37 in a perpendicularly intersecting relationship to each other. The single yarns $Y_1$ and $Y_2$ running along the yarn running path 30 may pass the intersecting location of the projected beams of light.

Then, when the single yarns $Y_1$ and $Y_2$ drafted by the drafting device 1 and spun out from the twisting device 2 are doubled by the guide member 17 and reach the detecting means of the optical yarn sensor 16, the single yarns $Y_1$ and $Y_2$ run along the U-shaped yarn running path 30 and pass the intersecting location of projected beams of light from the light projecting elements 34 and 35 to the light receiving elements 36 and 37 of the photoelectric sensors 32 and 33. The light receiving element 36 of the photoelectric sensor 32 obtains a sensed amount A from a shadow of the single yarns $Y_1$ and $Y_2$ passing the intersecting location thereupon while the light receiving element 37 of the photoelectric sensor 33 obtains a sensed amount B in a similar manner. The individual sensed amounts A and B are sent to the calculating means of the yarn detecting device 16 of the present invention at which a total value between them is calculated, and then, the total value is compared with a reference value to detect the presence or absence of a yarn break of one or more of the single yarns constituting the doubled yarn. When a yarn break is detected, a signal is developed quickly to control the operation of a textile machine such as a yarn doubling and take-up machine.

Figure 3:
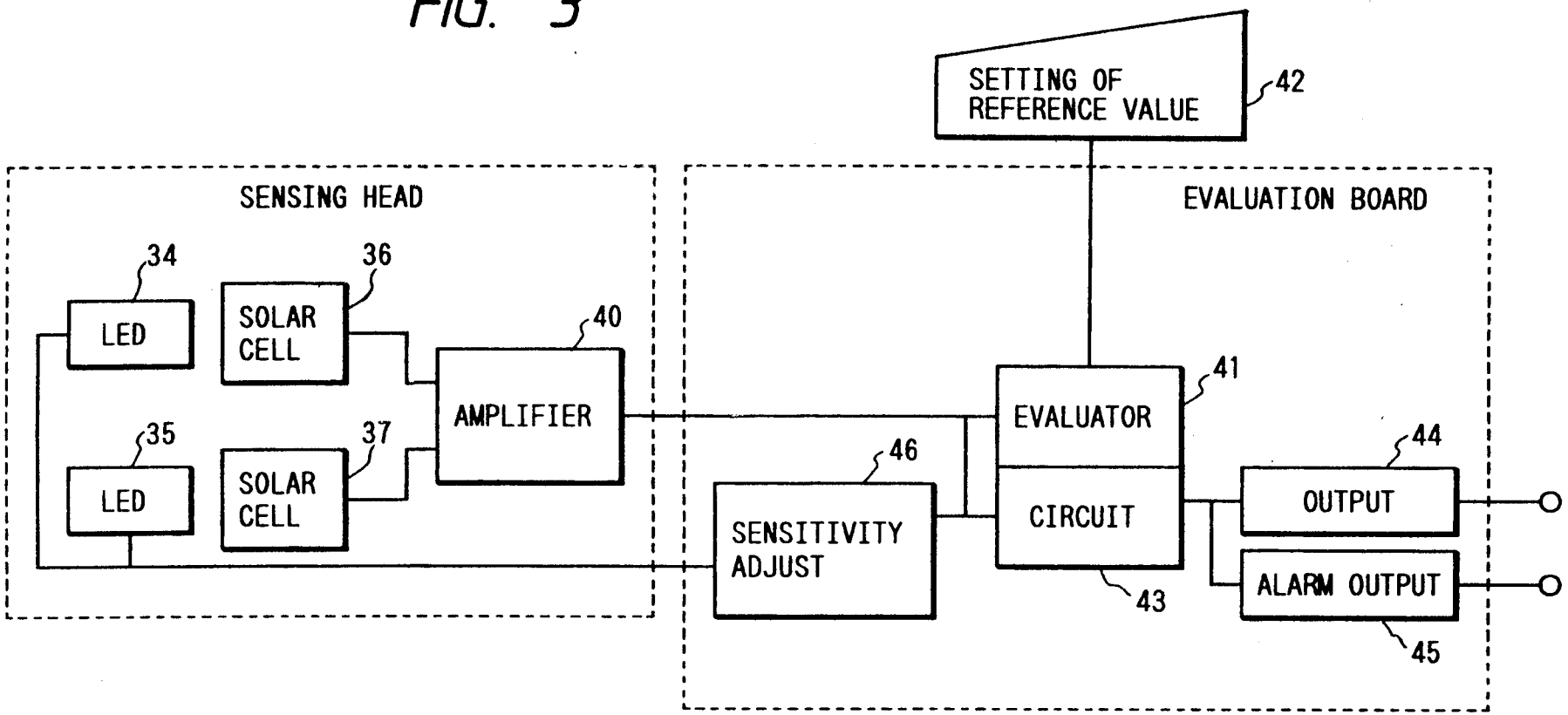
FIG. 3 is a block circuit diagram illustrating one embodiment of a detecting circuit.

An example of a calculating means for signals obtained by the photoelectric sensors 32 and 33, that is, a processing circuit, is shown in FIG. 3. The light amount is varied according to variation of thickness of a yarn running between the light projecting element 34 such as a light emitting diode (LED) and the light receiving element 36, and between the light projecting element 35 and the light receiving element 37. Then, voltage in relation to the yarn thickness is input into the amplifier 40, and is added up to be a suitable signal for processing. This sensing amount is input into a comparison operation circuit 41. Reference values determined due to thickness of a single yarn, thick portion or thin portion of a yarn for detecting a slub and the like are input into the comparison operation circuit 41 by the setting means 42. The detected sensing amount is compared with the set value. When the sensed amount is beyond the range of the set value, it is determined that at least one of the single yarns is broken or there is defects in the yarn such as slub, and immediately a signal is output from the circuit 43 to operate the cutter 20 or to actuate a solenoid for releasing a cradle and output (44) a signal for demanding a yarn joining operation. If the yarn joining operation is impossible, for example, in the absence of slivers to be supplied or clogging of a nozzle, a signal indicating impossibility of yarn joining operation is output (45).

The numeral 46 designates an automatic sensitivity adjusting circuit wherein a level of detecting signal is automatically adjusted when the level of the detecting signal becomes low because the surfaces of the light projecting elements 34 and 35 or light receiving elements 36 and 37 become dirty.

As described in detail so far, a device for detecting a yarn according to the present invention comprises a detecting means including a pair of photoelectric sensors disposed in a plane perpendicular to a running path of a yarn provided in a housing such that beams of light projected from light projecting elements may reach light receiving elements in a perpendicularly intersecting relationship to each other. Shadows of a plurality of single yarns passing the intersecting location of the projected light beams are detected by the photoelectric sensors as sensed amounts individually at the light receiving elements of the photoelectric sensors. A calculating means for adding up sensed amounts individually detected by the light receiving elements of the pair of photoelectric sensors and comparing the added up value with a reference value to detect a break of one or more of the single yarns of the doubled yarn. Accordingly, whichever positions in the intersecting location of projected beams of light from the pair of photoelectric sensors are occupied by single yarns while the single yarns are running along the yarn running path, the added up value of sensed amounts obtained by the photoelectric sensors exhibits a substantially fixed value which is approximate to the reference value if there is no break of the single yarns. Accordingly, by provision of the yarn detecting device of the present invention at the yarn path after yarns are doubled, a break of one or more of the single yarns constituting the doubled yarn can be detected with a high degree of accuracy in detection.

Another embodiment of the present invention will be illustrated hereinafter. According to this embodiment, an optical yarn sensor comprises a photoelectric sensor disposed in a plane substantially perpendicular to a running path of a yarn provided in a housing such that a beam of light projected from a light projecting element may be reflected by two reflecting plates and then reach a light receiving element in an intersecting relationship to itself, wherein a shadow of a plurality of single yarns passing the intersecting location of a projected light beam of the photoelectric sensor is detected as a sensed amount at the light receiving element of the photoelectric sensor.

The optical yarn sensor detects a break of a single yarn by grasping a shadow of a plurality of single yarns running along the yarn running path and passing the intersecting location of a projected light beam from the light projecting element of the photoelectric sensor which is reflected by the two reflecting plates and reaches the light receiving element as a total thickness of them whatever positions are occupied by the individual single yarns while they are running, then detecting the total thickness as a sensed amount at the light receiving element of the photoelectric sensor, and then comparing the sensed amount with a reference value.

Figure 4:
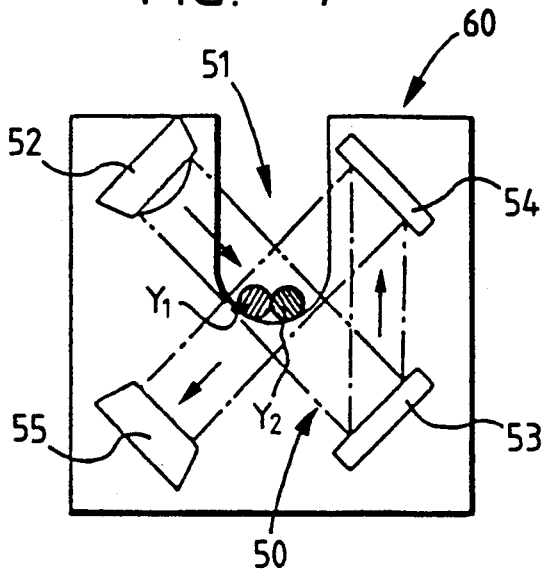
FIG. 4 is a front elevational view of the optical yarn sensor of the second embodiment.

A sensor 50 of this embodiment is shown in FIG. 4.

The photoelectric sensor 50 is disposed on a plane perpendicular to the yarn running path 51 such that a projected beam of light from a light projecting element 52 thereof may be reflected by two reflecting plates 53 and 54 and may reach a light receiving element 55 in an intersecting relationship to itself and the single yarns $Y_1$ and $Y_2$ running along the yarn running path 51 may pass the intersecting location of the projected beam of light.

Then, when the single yarns $Y_1$ and $Y_2$ drafted by the drafting device 1 and spun out from the twisting device 2 are doubled by the guide member 17 and reach the optical yarn sensor 16 of the present invention, the single yarns $Y_1$ and $Y_2$ run along the U-shaped yarn running path 51 and pass the perpendicularly intersecting location of a projected beam of light from the light projecting element 52 of the photoelectric sensor 50 which is reflected by the two reflecting plates 53 and 54 and then reaches the light receiving element 55. Then, the light receiving element 55 of the photoelectric sensor 50 grasps a total thickness of the single yarns passing the perpendicularly intersecting location and obtains a sensed amount from a shadow of the single yarns $Y_1$ and $Y_2$ regardless of the positions occupied by the single yarns $Y_1$ and $Y_2$ when they are running. The amount is compared with a reference value to detect the presence or absence of a yarn break of one or ones of the single yarns constituting the doubled yarn. In particular, if either one of the single yarns $Y_1$ and $Y_2$ becomes broken, then the shadow reaching the light receiving element 55 becomes reduced, and consequently, the difference between the sensed amount and the reference value is increased to thus detect the yarn break. Consequently, a signal is developed quickly to control operation of a textile machine such as a yarn doubling and take-up machine.

In the example described above the reflecting plates 53 and 54 are disposed such that a projected beam of light may intersect itself in a perpendicular relationship, thus a thickness of the yarns $Y_1$ and $Y_2$ and a single yarn break can be detected with a very high degree of accuracy. However, where the accuracy may be sacrificed a little (for example, when only a single yarn break should be detected), the intersecting angle of a projected beam of light may be different from the right angle, and in this instance, since the reflecting plates 53 and 54 are disposed proximately to each other, the thickness of the sensor 60 can be reduced so that the sensor may be disposed within a narrow spacing.

The detecting circuit shown in FIG. 3 may be applied to this embodiment if a pair of the light projecting element 35 and the light receiving element 37 of the detecting head are omitted.

As described in detail so far, an optical yarn sensor comprises a photoelectric sensor disposed in a plane substantially perpendicular to a running path of a yarn provided in a housing such that a beam of light projected from a light projecting element may be reflected by two reflecting plates and then reach a light receiving element in an intersecting relationship to itself, wherein a shadow of a plurality of single yarns passing the intersecting location of a projected light beam of the photoelectric sensor is detected as a sensed amount at the light receiving element of the photoelectric sensor. Accordingly, whichever positions are occupied by the individual single yarns in the intersecting location of a projected light beam of the photoelectric sensor while the single yarns are running along the yarn running path, the sensed amount obtained by the photoelectric sensor exhibits a substantially fixed value proximate the reference value if there is no break of a single yarn. Consequently, by providing the optical yarn sensor of the present invention at the yarn path after yarns are doubled, a break of one or ones of single yarns constituting a doubled yarn can be detected with a high degree of accuracy in detection.

Further, a yarn irregularity of each single yarn can be detected by detecting a thickness of a yarn as a whole although discrimination for each single yarn is impossible.

Figure 5:
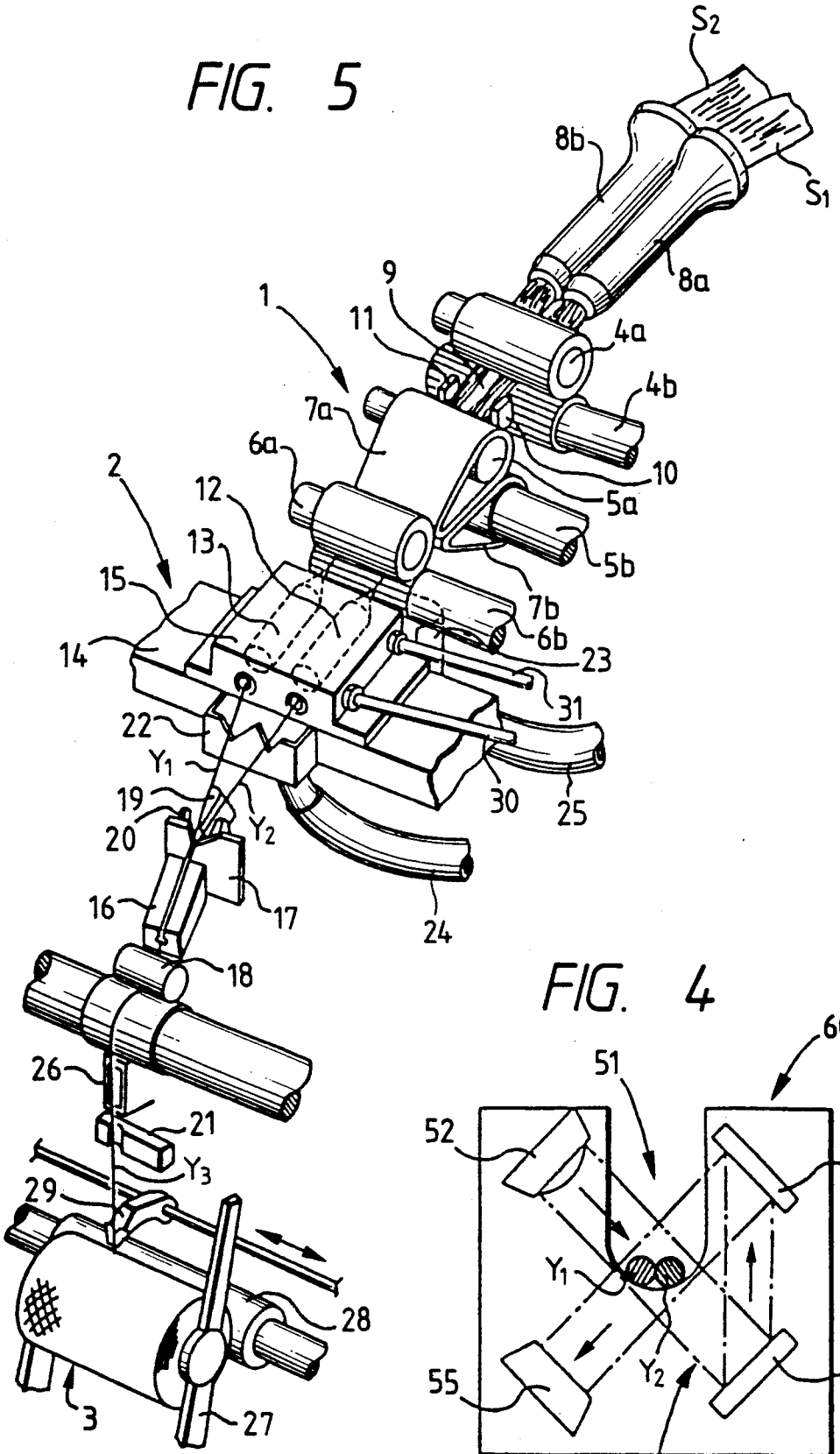
FIG. 5 is a perspective view showing another embodiment of the textile machine of the yarn doubling type which provides an optical yarn sensor.

In the embodiment mentioned above, the sensors 16 and 60 are provided at the downstream side of the delivery roller 18 as a device also providing with a function of a slub catcher as shown in FIG. 1. However, the sensors 16 and 60 can be located between the guide and the delivery roller 18 as a sensing device for detecting a single yarn independently of the slub catcher as shown in FIG. 5.

What is claimed is:

1. An apparatus for detecting yarn breakage of at least one yarn strand of a doubled yarn in a yarn doubling and taking-up machine, the apparatus comprising:

light producing means for producing a plurality of intersecting light beams, the doubled yarn passing through an intersection point of said plurality of light beams;

sensing means for sensing the plurality of intersecting light beams, the intersection point being disposed between the light producing means and the sensing means;

calculating means for determining an amount of light sensing by the sensing means; and means for comparing the determined amount with a reference value to detect a breakage of at least one yarn strand in the doubled yarn.

2. An apparatus according to claim 1, wherein the sensing means comprises a pair of photoelectric sensors, and wherein the plurality of intersecting light beam perpendicularly intersect one another prior to reaching the pair of photoelectric sensors.

3. An apparatus according to claim 2, wherein the pair of photoelectric sensors have a sensitivity level, the apparatus further comprising:

means for automatically adjusting an intensity of the plurality of intersecting light beams based on the sensitivity level of the pair of photoelectric sensors.

4. An apparatus according to claim 1, wherein the light producing means comprises a pair of light emitting diodes disposed so as to produce light beams which perpendicularly intersect.

5. An apparatus according to claim 4, wherein the pair of light emitting diodes have an adjustable intensity level, the apparatus further comprising:

means for automatically adjusting the intensity level in response to the determined amount of light sensed by the sensing means.

6. An apparatus according to claim 1, further comprising:

setting means for setting the reference value;

a cutter for cutting at least one yarn strand in the yarn doubling and taking-up machine;

alarm means for indicating an alarm; and control means, responsive to the comparing means, for providing a first output signal to operate the cutter when the sensed amount is in a predetermined range of values, and for providing a second output signal to operate the alarm means based on predetermined operating conditions of the yarn doubling and taking-up machine.

7. An apparatus according to claim 1, further comprising:

a housing for containing the light producing means and sensing means.

8. An apparatus according to claim 7, wherein the housing includes a section through which the doubled yarn passes and the intersection point of the plurality of intersecting light beams is disposed in the section.

9. An apparatus according to claim 8, wherein the section through which the doubled yarn passes comprises a U-shaped indentation in housing.

10. An apparatus for detecting yarn breakage of at least one yarn strand of a doubled yarn in a yarn doubling and taking-up machine, the apparatus comprising:

light producing means for producing an original light beam;

reflecting means for reflecting the original light beam such that the reflected light beam intersects the original light beam, the doubled yarn passing through an intersection point of the original light beam and the reflected light beam;

sensing means for sensing the reflected light beam after the reflected light beam passes through the intersection point;

calculating means for determining an amount of light sensed by the sensing means; and means for comparing the determined amount with a reference value to detect a breakage of at least one yarn strand in the doubled yarn.

11. An apparatus according to claim 12, wherein the reflecting means comprises a pair of reflecting plates.

12. An apparatus according to claim 11, wherein the pair of reflecting plates are disposed such that the original light beam and the reflected light beam perpendicularly intersect.

13. An apparatus according to claim 12, further comprising:

a housing for containing the light producing means, reflecting means and sensing means.

14. An apparatus according to claim 13, wherein the housing includes a section through which the doubled yarn passes and the intersection point of the original light beam and the reflected light beam is disposed in the section.

15. An apparatus according to claim 14, wherein the section through which the doubled yarn passes comprises a U-shaped indentation in the housing.

* * * * *